US006931901B2

(12) United States Patent
Ghiran et al.

(10) Patent No.: US 6,931,901 B2
(45) Date of Patent: Aug. 23, 2005

(54) METHOD AND APPARATUS FOR FORMING A THREADED HOLE IN A HYDROFORMED PART

(75) Inventors: Mircea M. Ghiran, Lake Orion, MI (US); Spyros Pete Mellas, Waterford, MI (US); Benjamin D Kaufman, St. Clair, MI (US)

(73) Assignee: General Motors Corporation, Detroit, MI (US)

( * ) Notice: Subject to any disclaimer, the term of this patent is extended or adjusted under 35 U.S.C. 154(b) by 90 days.

(21) Appl. No.: 10/690,100

(22) Filed: Oct. 21, 2003

(65) Prior Publication Data

US 2005/0081589 A1 Apr. 21, 2005

(51) Int. Cl.[7] ..... B21D 26/02; B21D 28/18

(52) U.S. Cl. ..... 72/55; 72/370.27; 83/54; 29/421.1

(58) Field of Search ..... 72/55, 58, 61, 72/62, 370.27; 83/54, 53; 29/897.2, 421.1

(56) References Cited

U.S. PATENT DOCUMENTS

| | | | | |
|---|---|---|---|---|
| 93,824 A | | 8/1869 | Humphreys | |
| 188,405 A | | 3/1877 | Peterson et al. | |
| 623,614 A | | 4/1899 | Mueller | |
| 2,278,377 A | | 3/1942 | Cook | 85/47 |
| 2,300,310 A | | 10/1942 | Poeton | 10/141 |
| 2,561,036 A | | 7/1951 | Sodders | 85/36 |
| 3,131,407 A | | 5/1964 | Roberts | 10/152 |
| 3,238,836 A | | 3/1966 | Johnson | 85/47 |
| 3,245,099 A | | 4/1966 | Zagar | 10/140 |
| 3,919,871 A | * | 11/1975 | Andrasev et al. | 72/55 |
| 4,316,683 A | | 2/1982 | Schott | 408/219 |
| 4,708,542 A | | 11/1987 | Emannuelli | 408/144 |
| 5,725,336 A | | 3/1998 | Vilmanyi et al. | 408/219 |
| 5,737,952 A | * | 4/1998 | Baumann et al. | 72/55 |
| 5,902,079 A | | 5/1999 | Moore | 408/215 |
| 6,098,437 A | * | 8/2000 | Kocer et al. | 72/55 |
| 6,442,820 B1 | * | 9/2002 | Mason | 29/421.1 |
| 6,591,648 B1 | * | 7/2003 | Ash et al. | 72/55 |
| 6,681,611 B2 | * | 1/2004 | Haag et al. | 83/54 |

* cited by examiner

*Primary Examiner*—David Jones
(74) *Attorney, Agent, or Firm*—Charles E. Leahy

(57) ABSTRACT

Method and apparatus are disclosed wherein a required threaded hole is formed in a hydroformed part with a single tool while the part remains in a hydroforming die cavity. In forming the threaded hole, a hole is first pierced in the wall of the part and then an annular region of the part extending about the hole is extruded inwardly to form an integral tubular neck defining a hole of predetermined depth. The hole is then expanded in a sizing operation to a diameter determined by the required thread to be formed therein by material displacement and the required thread is then formed in the wall of the hole in a material displacing manner.

16 Claims, 5 Drawing Sheets

118
162
128
210
214
204
166
150
114
112
158
140

118
162
140
210
214
218
208
212
204
166
150
114
128
112

118
162
210
214
128
158
208
212
204
218
166
150
114
112

118
162
128
210
214
158
208
212
204
52
218
150
114
112

118
162
112
128
158
140
210
204
114
140
168

METHOD AND APPARATUS FOR FORMING A THREADED HOLE IN A HYDROFORMED PART

TECHNICAL FIELD

This invention relates to forming a threaded hole in a hydroformed part and more particularly to doing so while the part remains in the hydroforming dies.

BACKGROUND OF THE INVENTION

There is a desire in the production of hydroformed tubular metal parts to be able to form a precise and accurate threaded hole in the hydroformed part. Without requiring that this be done as a secondary operation following removal of the part from the hydroforming dies as is presently done. Recognizing that if a required threaded hole could be made in an in-die procedure while the hydroformed part remains in the dies and without producing a slug or chips, there are considerable time and cost savings to be gained.

Moreover, it is known that required holes of various shapes can be pierced in the hydroformed part in a hydropiercing and extruding operation while the part remains in the dies under internal pressure and without producing a slug that could fall into the part and later have to be removed. So it would also be to considerable advantage if the formation of a required threaded hole in the part could be accomplished simultaneously therewith. Without either of these operations producing a slug or chips and thereby not require additional processing or cycle time or cleanup or a secondary operation.

There are of course a wide variety of thread cutting and thread forming taps for tapping a thread in a preformed hole in a part. With the advantage of the latter type of taps being to precisely and accurately form a stronger thread by displacing material without producing chips. However, conventional thread forming taps while not producing chips nevertheless still require that a hole first be formed in the part. Furthermore, the wall of the hydroformed parts is typically not thick enough to allow the number of threads necessary to securely hold a particular screw or bolt to the hydroformed part or to allow the use of self-tapping screws or bolts. And in that event, weld nuts are typically added in a secondary operation.

SUMMARY OF THE INVENTION

With the method and apparatus of the present invention, a hole is formed and threaded in a hydroformed part in an in-die procedure and in a manner that does not produce either a slug or chips. Wherein the apparatus comprises a compact hole and thread forming unit that can readily be incorporated in otherwise conventional hydroforming apparatus and performs all its operations while the hydroformed part remains in the dies.

The hole and thread forming unit comprises a combined hole piercing, extruding, hole sizing and thread forming tool and an actuator device that advances and retracts the tool and also selectively rotates the tool in both a forward and reverse direction for the threading and tool retraction operations. Wherein the tool is fed at a feed rate determined by the pitch of the thread to be formed in a threading operation and is retracted at the same rate but in the opposite rotational direction to release the tool from the formed thread. And for the purpose of distinguishing the present invention from conventional thread forming taps and how they are operated, the manner of tapping in accordance with the present invention is hereinafter referred to as "hydrotapping" in light of the accepted term "hydropiercing". Wherein the latter term is used to describe a piercing operation that is performed in an in-die procedure on the hydroformed part while the hydroforming pressure is maintained therein following its formation against the die cavity surface. And with the recognition that in the present invention the threaded hole is formed in the hydroformed part while the part also remains in the hydroforming dies following its hydroforming and the hydroforming fluid is maintained at pressure in the part to support certain operations of the tool according to the present invention.

In practicing the invention, the hole and thread forming unit is mounted on one of the dies with its tool closely received in a through bore in this die opposite where a threaded hole is required in the hydroformed part. The tool is a one-piece tool having a hole-piercing end portion at one end, an extruding portion adjoining the end portion, a hole-sizing portion adjoining the extruding portion, a relief portion adjoining the hole-sizing portion, a thread-forming portion adjoining the relief portion, and a tool-fastening portion at the other end of the tool.

The hole piercing end portion is adapted on advancement of the tool by the actuator device to pierce and form a hole in the part without producing a slug and while hydroforming pressure remains in the part to support this operation. The extruding portion of the tool is on the other hand adapted on continued tool advancement to enter the pierced hole and extrude an annular region of the part to a predetermined depth inward of the part while expanding the hole to an undersize diameter along its depth and with this operation being assisted with a flushing and lubricating action by the hydroforming fluid that is forced by the pressure remaining in the part after the piercing operation.

The hole-sizing portion of the tool has a partial thread by which it is adapted at its crest and on continued tool advancement to radially expand the extruded annular portion to enlarge the hole to a predetermined diameter. Wherein the extruding formation and the hole sizing of the annular extruded portion forms a hole having a wall thickness essentially the same as the part but a depth dimension that is considerably larger than the wall thickness and that can be varied by the amount of extrusion to allow for a sufficient number of threads to securely hold a particular screw or a bolt.

The thread-forming portion of the tool has a full thread that with the intervening relief portion is an interrupted continuation of the partial thread and has the same pitch but a relatively sharp edged crest and a larger major diameter. The full thread is by selection of the proper thread forming configuration adapted to form the required thread in the wall of the hole on continued tool advancement and now turning of the tool in the proper direction. Wherein the tool is fed at a feed rate equal to the pitch of the tool threads (both the full and the partial thread) and that of the required thread. And wherein the relief portion of the tool minimizes the friction for starting rotation of the tool to form the thread where after the trailing full thread of the tool at the above feed rate produces a strong and precise thread in the extruded annular section of the hydroformed part by displacing or reorienting material rather than removing material as with a thread cutting tap.

Following the forming of the threaded hole in the part, the tool is simply retracted at the same feed rate while being rotated in the opposite direction by the actuator device to free the tool from the thus finished hydroformed part with the required threaded hole and allow the finished part to be removed from the dies. With the partial thread of the tool by virtue of its smaller major diameter not wiping out the formed thread in the part as the tool is threadably backed out at the above feed rate.

In the operational description above, the tool is not rotated during the piercing, extruding and hole-sizing operations to minimize the requirements of the tool actuator. On the other hand, the tool may also be rotated during these operations with the result that better hole definition is made possible by reducing the possibility of collapse of the surrounding wall of the part. Moreover, with the present invention the threaded hole can be formed concurrently with the formation of one or more holes that are also required in the hydroformed part using a hydropiercing operation. As a result, the formation of the threaded hole using both a hydropiercing operation and a hydrotapping operation in forming a required threaded hole in the part in accordance with the present invention and concurrently with a separate hole forming hydropiercing operation still does not add substantially to the total cycle time required to process a part that requires both a threaded hole and a plain hole. And with the added advantage that neither a slug or chips are produced in the processing of such a part.

These and other aspects of the present invention will become more apparent from the accompanying drawings and the following description of an exemplary embodiment of the invention.

DESCRIPTION OF EXEMPLARY EMBODIMENTS

Figure 1:
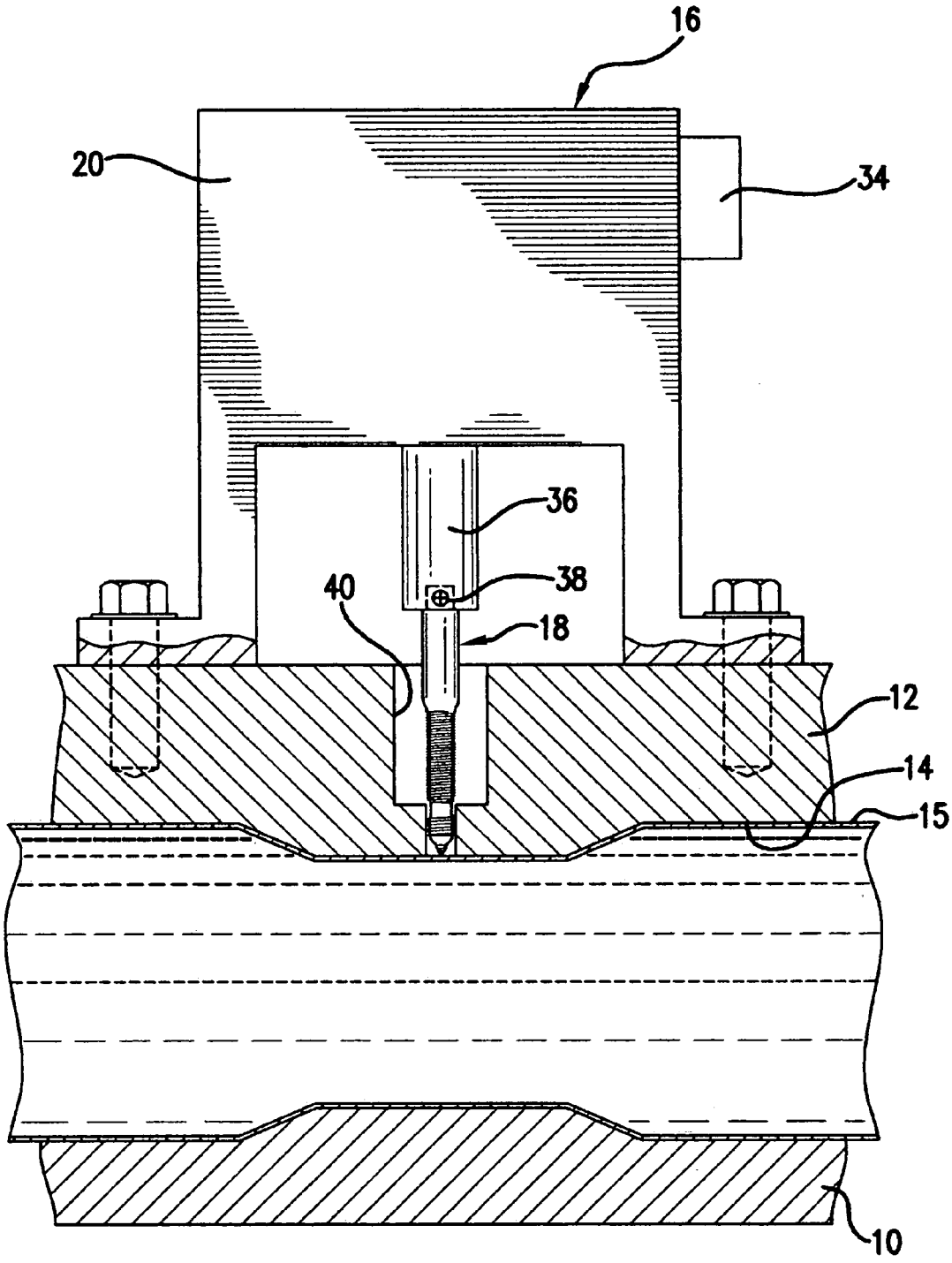
FIG. 1 is a partial side view in section of hydroforming apparatus incorporating an in-die, hole forming, hydrotapping unit according the present invention comprising a tool and actuator device as employed to completely form a required threaded hole in a hydroformed part.

Referring to FIG. 1, there is shown a portion of a conventional hydroforming apparatus comprising a lower die 10 and an upper die 12 that co-operatively form a cavity 14 having a surface conforming to the required shape of the finished part. In the hydroforming process and in a conventional manner, a piece of tubular metal stock is captured between the dies in the die cavity and a hydroforming fluid typically in the form of a water based liquid solution is then delivered through one end of the part to the interior of the part while exit from the other end is blocked. With the hydroforming fluid thus delivered being maintained at a pressure sufficient to forcibly expand the wall of the captured part outward against and conform to the cavity surface to thereby form a hydroformed part 15 having the required shape. It will also be understood that following the formation of a threaded hole required in the hydroformed part as described below and also possibly the formation of one or more required holes in hydroformed part that could be accomplished simultaneously therewith, the hydroforming fluid that remains in the finished part is then exhausted and also in a conventional manner-through the above-mentioned other end to permit opening of the dies and removal of the finished part.

Further details of the type of hydroforming apparatus for which the present invention is suited are for example disclosed in U.S. Pat. No. 5,321,964 assigned to the assignee of this invention and which is hereby incorporated by reference. And details of various types of apparatus for hydropiercing a required hole in a hydroformed part while remaining in the hydroforming dies are for example disclosed in U.S. Pat. Nos. 5,398,533 and 5,666,840 which are also assigned to the assignee of this invention and which are hereby also incorporated by reference.

The formation of a required threaded hole in the hydroformed part 15 which can be performed simultaneously with the piercing of one or more required holes in the part is provided by a hole and thread forming unit 16 comprising a singular tool 18 and an actuator device 20 that operates the tool 18. The tool 18 also being referred to herein as a hydrotapping tool in view of its functioning.

Figure 2:
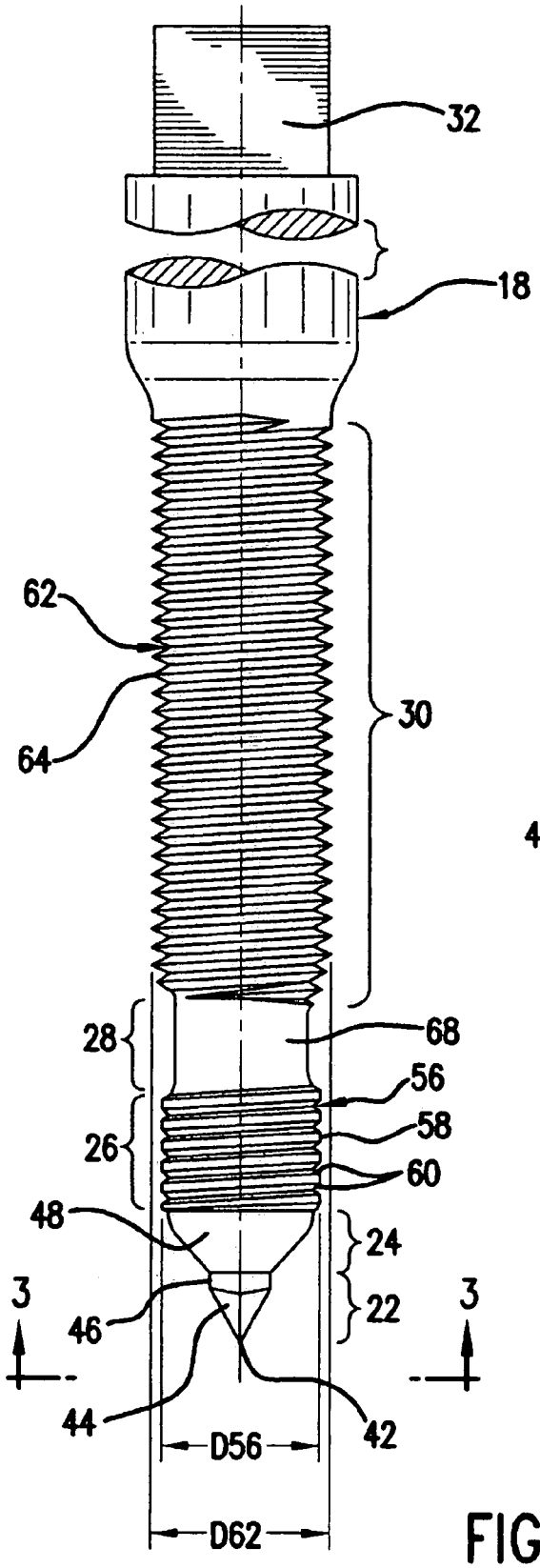
FIG. 2 is an enlarged view of the tool in FIG. 1.
Figure 3:
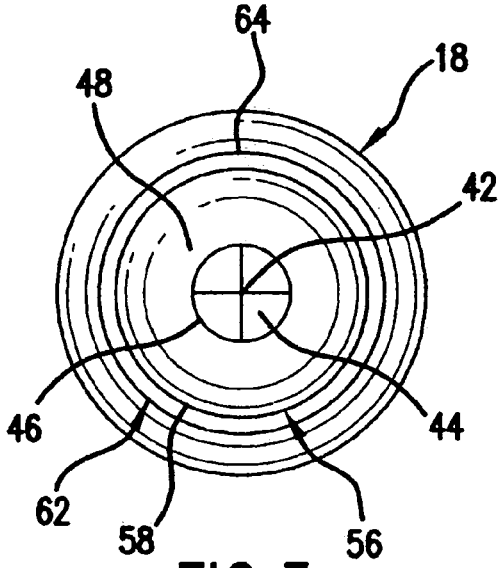
FIG. 3 is an enlarged view taken along the lines 3—3 in FIG. 2 when looking in the direction of the arrows.

Referring to the enlarged views in FIGS. 2 and 3, the hydrotapping tool 18 is a flute-less, one-piece tool that is made of suitable tool steel and comprises a plurality of differently configured portions. With these portions comprising a hole-piercing end portion 22 at one end of the tool, an adjoining extruding portion 24, an adjoining hole-sizing or expanding portion 26, an adjoining relief portion 28, an adjoining thread forming portion 30, and a square or other suitably shaped shank portion 32 at the other end of the tool for fastening the tool to the actuator device 20.

The actuator device 20 which is also referred to as a drive unit is of any suitable type adapted to drive the tool 18 in the manner prescribed herein. For example, the actuator device 20 may be an electric motor powered drive unit or an electo-hydraulic powered drive unit or other type of suitable drive unit. Wherein the actuator device has a programmable control system 34 and a projecting drive shaft 36 having a drive socket in the end thereof in which the shank end portion 32 of the tool 18 is inserted and held with a setscrew 38. And wherein the actuator device is operational to advance, retract and rotate the drive shaft 36 and thereby the tool 18. And wherein certain prescribed feed rates can be programmed into the control system 34 to advance and retract the tool 18 at variable linear feed rates and also rotate and feed the tool 18 at a certain feed rate matching the pitch of the particular thread for which the tool is adapted to tap as described in more detail later.

The threaded hole required in the hydroformed part may for example be located on the upper side of the part as viewed in FIG. 1 and the unit 16 is accordingly rigidly mounted as shown on the top of the upper die 12. Wherein the end of the drive shaft 36 and the smaller diameter tool 18 are closely receivable in a stepped bore 40 that extends through the upper die 12 and through the die cavity surface therein and is in alignment with where the threaded hole is required in the hydroformed part.

Figure 4:
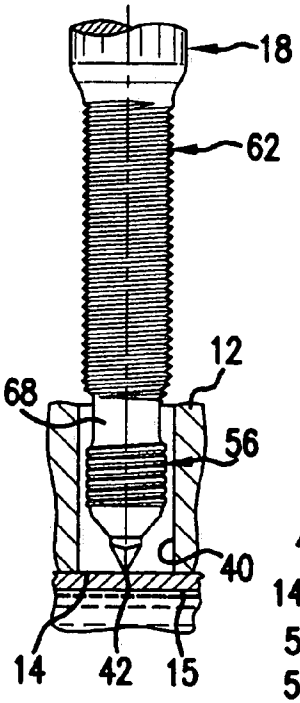

Referring to FIGS. 2 and 3 and describing further the various and diverse features of the tool 18 and how they function by operation of the actuator device 20 and in relation to the hydroformed part 15, the piercing end portion 22 of the tool 18 has a pointed end 42 with an adjoining radially outwardly diverging or outwardly angled multi-faceted surface 44 and a cylindrical surface 46 that adjoins the faceted surface 44. And the tool is initially located by the actuator device 20 at the start of the hydroforming process in a position where the tool point 42 is flush with the surrounding cavity surface as shown in FIGS. 1 and 4. However, it will also be understood that the tool point 42 may be positioned in a slightly retracted position with respect to the surrounding die cavity surface as it was found that this would also not adversely affect the subsequent tool operation described below.

The tool 18 is advanced by the actuator device 20 immediately following the hydroforming of the part while the hydroforming pressure is maintained therein with such initial tool advancement causing the pointed end 42 and then the trailing faceted surface 44 and then the trailing cylindrical surface 46 to sequentially and progressively pierce a hole in the wall of the part without producing a slug. Wherein the hydroforming pressure supports the wall of the part against collapsing and distorting during the piercing operation at least until the pressure drops significantly at the point where the wall is actually pierced through. And with it being understood that in this example, the wall of the part is sufficiently strong because of its thickness and/or type of material so as to prevent premature piercing of the wall by the hydroforming pressure forcing the wall outward against the pointed end 42 of the tool during the hydroforming of the part.

Figure 5:
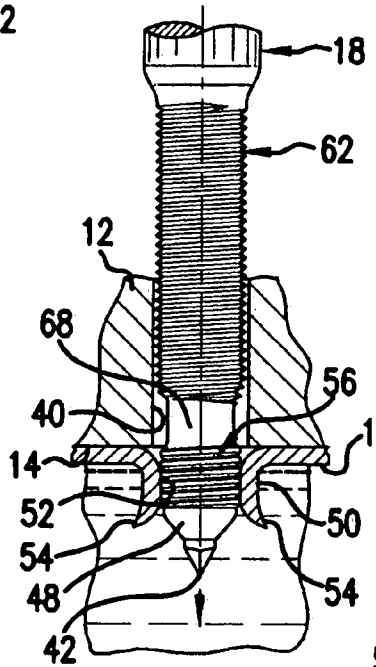

The extruding portion 24 of the tool 18 has a conical surface 48 diverging radially outward from the cylindrical surface 46 of the tool end portion 22 and by which the tool is adapted on continued advancement by the actuator device 20 to enter the pierced hole and extrude an annular region of the part extending about the pierced hole to a predetermined depth inward of the part. Thereby forming an internal tubular neck portion 50 in the part defining a thus expanded and substantially deepened hole 52 in the part as shown in FIG. 5 prior to the expanding tool portion 26 entering the hole.

The faceted surface 44 of the piercing end portion 22 of the tool preferably has four triangular facets of equal size as shown and instead of producing a slug as a result of the piercing by the pointed end 42, there are resultantly produced four small appendages 54 by the faceted surface as the piercing proceeds and that remain integral with the inner edge of the neck portion 50. Only two of the appendages 54 which are diagonally opposite each other are shown and it will be understood that the other two are also diagonally opposite each other and spaced 90 degrees from those shown. However, it will also be understood that there may be more or a lesser number of facets and thus appendages to the neck portion depending on various factors such as the size of the hole being pierced and the amount of subsequent extrusion required. On the other hand, it will also be understood that a conical surface like the conical surface 48 of the extruding portion 24 but of substantially less radial dimensions can be substituted for the faceted surface 44 as it has been found that similar and equally satisfactory piercing is also obtained with such a modified form of the hole-piercing end of the tool 18.

It will also be understood that the hole 52 prior to entry of the expanding portion 26 of the tool is made undersize. And that the configurations of the respective hole piercing end portion 22 and extruding portion 24 of the tool 18 are determined dimensional wise for a particular application so as to pierce and extrude the wall of the part inwardly to the extent necessary to form the wall of the hole 52 with a depth or axial extent that allows the formation therein of the number of threads required to adequately secure a particular screw or bolt.

When the wall of the part is initially pierced in the hydropiercing operation by the piercing end portion 22 of the tool, there will occur a sudden drop in the hydroforming pressure within the part as indicated earlier. This pressure drop may for example be 80% of the forming pressure but it has been found that the remaining 20% is sufficient to force the hydroforming fluid to advantageously both flush and lubricate the extruding tool portion 24 to thus facilitate its extruding operation as it proceeds to advance into the pierced hole and extrude the wall inwardly of the part 15 and about the conical tool surface 48.

The hole-sizing or expanding portion 26 of the tool 18 expands the thus formed hole 52 to the precise diameter best suited for the cold forming of the required thread therein and for that purpose has a thread forming thread 56 (but only a partial one) with a reduced tip radius and having a crest defined by a cylindrical helical surface 58 with rounded edges 60. See FIG. 2. Whereby the expanding portion 26 is adapted on continued advancement of the tool by the actuator device 20 to efficiently radially expand the extruded tubular neck portion 50 along its depth or axial length to size the hole 52 to the desired diameter prior to the thread forming operation. And whereby the hole 52 is accurately and precisely sized as required by the subsequent thread forming operation to be performed by the thread-forming portion 30 as this portion of the tool enters the hole 52 on continued tool advancement as shown in FIG. 5.

Figure 6:
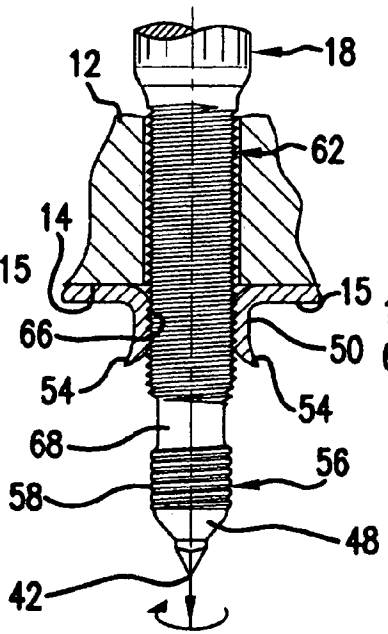

The thread-forming portion 30 of the tool 18 has a full thread-forming thread 62 that forms an interrupted continuation of the partial thread 56 with the same pitch and has a relatively sharp crest 64 and a larger major diameter D62 as compared to the partial thread 56 and its major diameter D56. See FIG. 2. The thread-forming portion 30 is thereby adapted on continued tool advancement and now also rotation of the tool 18 by the actuator device 20 at a feed rate equal to the pitch of the full thread 62 (and thus also that of the partial thread 56) to accurately and precisely form the required thread 66 in the wall of the hole 52 of the extruded and internally sized neck portion 50 as shown in FIG. 6. In such thread forming operation that results from displacing material in the inner wall of the neck portion 50 and as distinguished from a thread cutting operation, the full thread 62 displaces most of the material (approximately 95%) to the inside of the groove or crevice of this thread in forming the thread 66 in the wall of the hole 52. With the small remainder of material being displaced outward but not enough to make a significant difference in the outer surface of the hole defining tubular neck portion 50.

The relief portion 28 of the tool that is located between the expanding portion 26 and thread-forming portion 30 of the tool 18 has a smooth annular surface 68 whose maximum diameter is slightly less than the minor diameter of the partial thread 56 and the full thread 62. See FIG. 2. The purpose of the relief portion 28 being to minimize the friction between the tool and the extruded neck portion 50 formed in the part when the tool while continuing to advance is also initially started to rotate by the actuator device 20 to form the thread 66.

Figure 8:
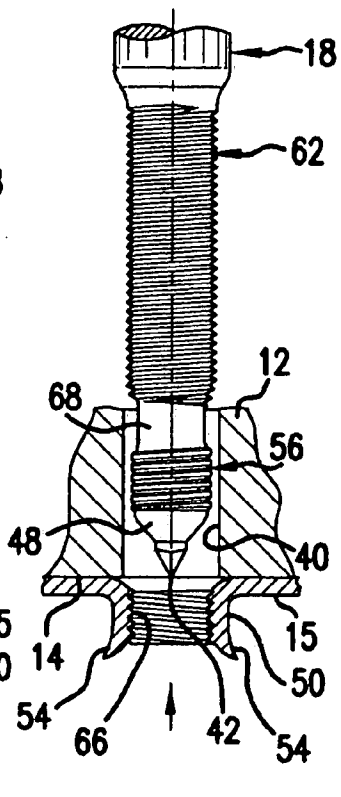
FIGS. 4–8 are partial views taken from FIG. 1 showing the sequential steps in the formation of a required threaded hole in the hydroformed part using the tool in FIGS. 1–3.
Figure 7:
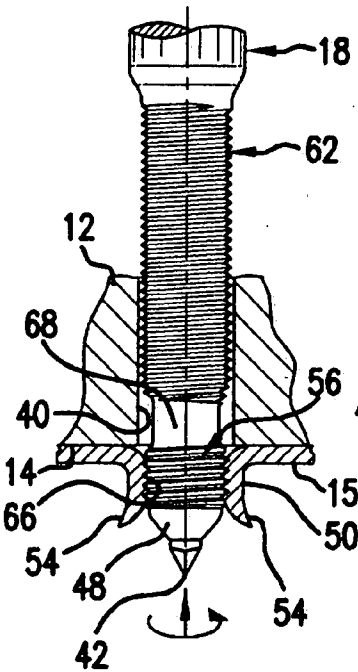

Following the formation of the thread 66 with the full forming thread 62, the tool 18 is then simply retracted from or backed out of the formed thread 66 by the actuator device 20 by the latter rotating the tool 18 in the reverse direction and retracting it at the same feed rate used to form the thread 66. Whereby the partial thread 56 follows the forming thread 62 and because of its smaller major diameter D56 being at its helical crest surface 58, the then trailing partial thread 56 does not wipe the crest off the formed thread 66. See FIG. 7. On exiting the thus formed threaded hole, the tool 18 is finally returned to its initial or starting position by the actuator device 20 where the tool is free of the hydroformed part 15 as shown in FIG. 8.

With the tool 18 returned to its initial starting position, the finished part is exhausted of any remaining hydroforming fluid in a conventional manner. The dies 10 and 12 are then opened by elevating the upper die 12 whereby the finished hydroformed part 15 with the required threaded hole can then be removed to clear the dies for the processing of another part.

As to the configuration of the tool 18 and the feed rate imparted to the tool 18 by the actuator device 20 as described above and in relation to a certain required threaded hole, the required thread may for example be an 8×1.25 mm thread. In that case, (A) the hole-piercing end portion 22, extruding portion 24 and the hole-sizing expanding portion 26 of the tool are dimensioned accordingly to form the desired dimensions for the resulting tubular neck portion 50, (B) the full thread 62 is formed with the required thread forming configuration for an 8×1.25 mm thread, (C) the partial thread 56 is provided with the same pitch but with a major diameter D56 at the surface 58 of its helical crest that is substantially smaller than the major diameter D62 of the full thread 62 such that the partial thread can freely return through a 8×1.25 mm thread, and (D) the relief portion 28 of the tool is provided with a maximum diameter slightly less than the minor diameter of the 8×1.25 mm thread. With the tool 18 thus configured, the control system 34 of the actuator device 20 is programmed to feed the tool 18 while turning the tool in the appropriate turning directions during the thread forming and tool extraction operations at a feed rate of 1.25 mm per tool revolution in order to form the required 8×1.25 mm thread and provide for tool extraction on reverse tool rotation without disturbing the formed thread.

In addition, it will be appreciated that while a certain prescribed feed and retraction rate of the tool is set for the respective thread forming and tool extraction operations according to the thread forming thread 62 and the thread required in the part, the tool 18 can be fed and retracted at certain linear rates that are found to be best suited for the piercing, extruding and expanding (hole-sizing) operations. Simply by programming the control system 34 of the actuator device 20 to feed the tool 18 at the optimum linear rates best suited to these operations and which for example can be determined by trial and error for each particular application during setup of the hole and thread forming unit 16. And wherein it will be understood that the same linear feed rate can be used for all these operations as well as the rate of tool retraction following these operations in order to minimize the operational requirements of the actuator device 20.

Where the wall thickness and/or the strength of the material of the part is not sufficient to support the wall against a sharp pointed piercing end of the tool as well as other advantageous reasons there is provided the embodiment shown in FIGS. 9–16. Wherein parts and features corresponding to those in FIGS. 1–8 are identified by the same reference numbers but in a one hundred (100) numbering series and distinctly different features are identified with reference numbers in a two hundred (200) numbering series.

Figure 9:
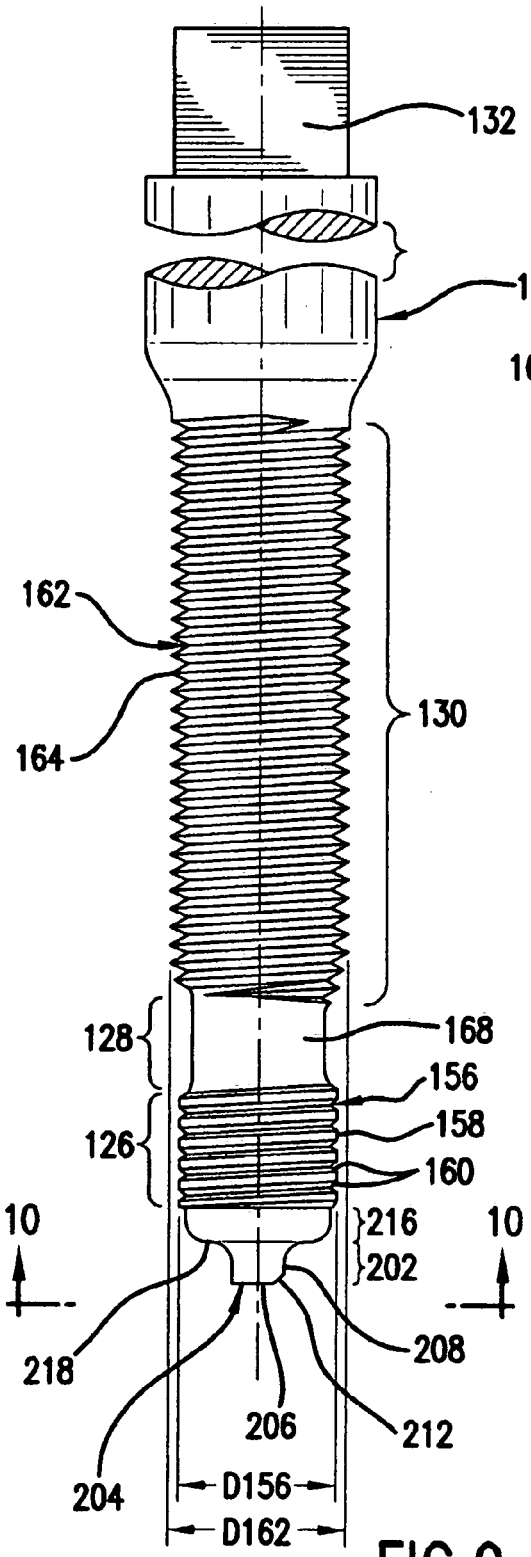
FIG. 9 is a view similar to FIG. 2 but of another embodiment of the tool.
Figure 10:
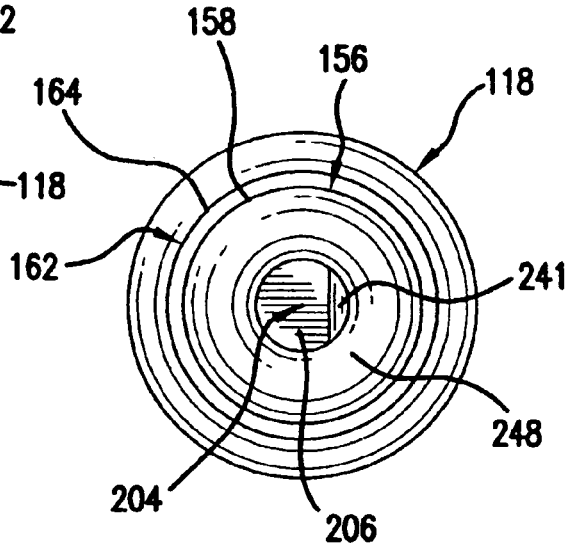
FIG. 10 is an enlarged view taken along the lines 10—10 in FIG. 9 when looking in the direction of the arrows.

Referring to FIGS. 9 and 10, the hydrotapping tool 118 is now provided with a hole piercing end portion 202 having a blunt end 204 with a flat mainly circular surface 206 that is at right angles to the tool axis and has an adjoining cylindrical surface 208. Wherein the diameter of the circular surface 206 forming the blunt end of the tool (which is also the diameter of the adjoining cylindrical surface 208) is significantly less than the minor diameter of the required thread as determined by the extent desired of the subsequent extrusion by the tool 118 of the neck portion 150 formed in a part a part 210 substantially different from part 15. See FIGS. 12–16. The part 210 in this example having a smaller wall thickness as shown and/or being formed of lesser strength material as compared with the part 15.

The tool 118 is thereby adapted at its piercing end to adequately support the wall of the part 210 against being prematurely pierced outwardly during the hydroforming of the part and which would otherwise occur if a sharp pointed tool end like that on the hydrotapping tool 18 was used for this particular part. In addition to preventing premature piercing, the blunt end 204 is provided with a flat chamfer 212 of limited annular extent that is at an acute angle to the blunt end surface 206 and intersects the otherwise sharp edge of the blunt end 204 and the adjoining cylindrical surface 208. With the piercing end of the tool 118 thereby being adapted to efficiently pierce the hole in the part as the cylindrical surface 208 of the tool progresses into the part and with the chamfer 212 produces a slug 214 from the piercing operation that is integrally retained as a part of the subsequently extruded tubular neck portion 150 of the part. See FIG. 13. Whereby the slug is not allowed to separate from the hydroformed part and fall into its interior and require subsequent removal.

The tool 118 is also provided with an extruding portion 216 of different configuration that has a concave-convex annular surface 218 that extends from the cylindrical surface 208 of the piercing end portion 202 of the tool to the relief portion 128 of the tool. See FIGS. 9 and 10. Wherein the extruding operation starts with the concave portion of the surface 218 of the tool extruding portion 216 first entering the pierced hole and finishes with the convex portion of this surface before the expanding portion 126 of the tool enters as the tool continues to be advanced.

Figures 12, 13, 14, 15, 16:
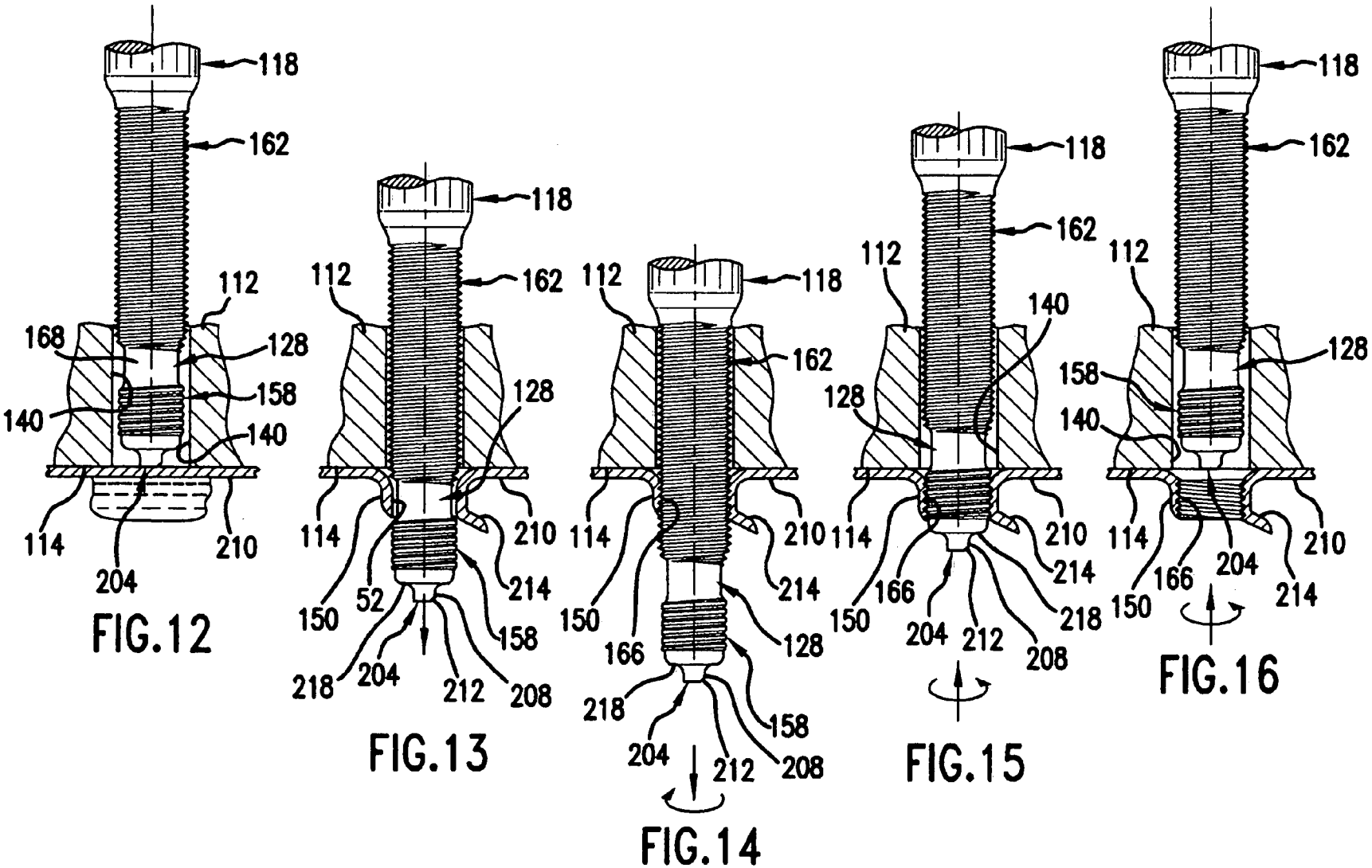

The tool 118 is otherwise the same as the tool 18 and operates to form the required threaded hole in the part as shown in FIGS. 12–16. With FIG. 12 showing the initial positioning of the tool 118, FIG. 13 showing the piercing, expanding and extruding operations having been performed and just prior to the threading operation, FIG. 14 showing the tool threading operation in forming the required thread 166, FIG. 15 showing the tool extraction operation, and FIG. 16 showing the tool fully retracted and ready for the commencement of another hole piercing and thread forming sequence of operations with another hydroformed part.

Figure 11:
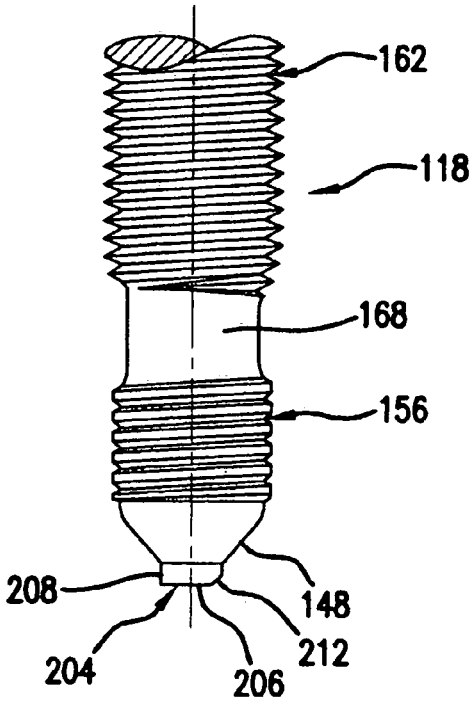
FIG. 11 shows a modified form of the piercing end of the tool in FIGS. 9 and 10, and FIGS. 12–16 are views similar to FIGS. 4–8 showing the sequential steps in the formation of a required threaded hole in the hydroformed part using the tool in FIGS. 9 and 10.

It will also be appreciated that the extruding portion of the tool 118 can instead of the concave-convex surface 218 have a conical surface 148 as shown in FIG. 11 like the conical surface 48 in the embodiment in FIGS. 2 and 3. As the desired extrusion is obtained with the tool 118 with either the concave-convex surface 218 or the conical surface 148 and with the slug 214 resulting from the prior piercing operation integrally remaining with the extruded neck portion formed in the part.

In the operation of the tool as thus far described and as shown by the directional arrows in the drawings, the tool is not rotated during the piercing, extruding and expanding (hole-sizing) operations. As such operation has the advantage of reducing the operational requirements of the actuator device 20 for driving the tool. On the other hand, it will be understood that the actuator device 20 is of a suitable type that is also operable to rotate the tool during the piercing, extruding and expanding operations. With the result being that the rotary motion of the tool minimizes the axial force required of the actuator device to produce these operations and can provide for even better hole definition by minimizing the possibility of collapse of the immediately surrounding portion of the wall of the part.

In addition to the capability of the tool according to the present invention, it can be simply made by tool manufacturers that normally produce thread-forming taps. For example, the partial and full thread portions and the relief portion can be formed by first forming a full thread as required that also spans the intended relief portion and the partial thread portion. Where after the overextended portion of the full thread is then simply removed by grinding operations to form the relief portion and the partial thread while leaving the remaining full thread as the actual thread forming portion of the tool. And wherein the hole-piercing end portion and extruding portion are also formed with grinding operations.

Having disclosed the presently preferred exemplary embodiments, various forms of both the method and apparatus are likely to result from such disclosure to those skilled in this art. Therefore, the invention is to be limited only by the scope of the appended claims.

What is claimed is:

1. A method of forming a threaded hole in a hydroformed part while the part remains in a hydroforming die cavity, said method comprising the steps of piercing a hole in the part while hydroforming pressure is maintained therein, extruding an annular region of the part about the hole to a predetermined depth inward of the part, expanding the interior of the extruded annular region to a predetermined inner diameter determined by a thread required to be formed therein by material displacement, and forming a thread in the interior of the extruded and expanded annular region in a material displacing manner.

2. A method as defined in claim 1 using a single tool to perform the piercing, extruding, expanding and thread forming operations.

3. A method as defined in claim 2 wherein the tool is fed at a feed rate equal to the pitch of the required thread to form the thread and is retracted at the same rate but in an opposite axial and rotational direction to remove the tool from the formed thread.

4. A method as defined in claim 2 wherein the tool is fed without rotation in performing the piercing, extruding, and expanding operations.

5. A method as defined in claim 2 wherein the tool is fed and rotated in performing the piercing, extruding, and expanding operations.

6. Apparatus having a tool adapted to form a threaded hole in a hydroformed part while the part remains in a hydroforming die cavity, said tool comprising a hole-piercing end portion adapted on advancement of the tool to pierce and form a hole in the part while hydroforming fluid under pressure remains in the part, an extruding portion adapted on continued tool advancement to extrude an annular region of the part extending about the hole to a predetermined depth inward of the part, an expanding portion adapted on continued tool advancement to expand the hole in the extruded annular region to a predetermined diameter determined by a thread to be formed therein by material displacement, and a thread forming portion adapted on continued tool advancement to form a thread in the extruded and expanded annular region of the part by material displacement.

7. Apparatus as set forth in claim 6 wherein the hole-piercing end portion of the tool has a pointed end with an adjoining faceted surface and a cylindrical surface adjoining the faceted surface.

8. Apparatus as set forth in claim 6 wherein the hole-piercing end portion of the tool has a pointed end with an adjoining conical surface, and a cylindrical surface adjoining the conical surface.

9. Apparatus as set forth as set forth in claim 6 wherein the hole-piercing end portion of the tool has a blunt end with a flat area of sufficient size to prevent premature piercing and a circular edge intersected at an acute angle to the flat area of the blunt end by a flat chamfer of limited annular extent, and a cylindrical surface adjoining the blunt end wherein the chamfer also intersects the cylindrical surface.

10. Apparatus as set forth in claim 6 wherein the extruding portion of the tool has a conical surface diverging radially outwardly from the hole-piercing end portion.

11. Apparatus as set forth in claim 6 wherein the extruding portion of the tool has a concave-convex annular surface extending from the hole-piercing end portion.

12. Apparatus as set forth in claim 6 wherein the expanding portion of the tool has a partial thread and the thread forming portion has a full thread with the same pitch as and a larger major diameter than the partial thread.

13. Apparatus as set forth in claim 12 wherein the tool has a relief portion between the partial thread and the full thread having a maximum diameter less than the minor diameter of the partial thread and the full thread.

14. Apparatus as set forth claim 6 further including an actuator device adapted to advance the tool to perform the piercing and extruding and expanding operations, rotate the tool in one direction while advancing the tool to form the thread at a feed rate equal to the pitch of the partial and full thread, and rotate the tool in the opposite direction while retracting the tool at the same rate in order to release the tool from the formed thread without the partial thread disturbing the formed thread.

15. Apparatus as set forth in claim 14 wherein the actuator device is also adapted to rotate the tool in performing the piercing and extruding and expanding operations.

16. Apparatus as set forth in claim 13 wherein the actuator is also adapted to feed the tool at variable linear feed rates while performing the piercing and extruding and expanding operations and also retract the tool at variable linear rates following the piercing and extruding and expanding operations.

* * * * *